US005649603A

United States Patent [19]

Simpson et al.

[11] Patent Number: 5,649,603

[45] Date of Patent: Jul. 22, 1997

[54] DOWNHOLE TOOLS HAVING CIRCUMFERENTIALLY SPACED ROLLING ELEMENTS

[75] Inventors: Neil Andrew Abercrombie Simpson, Aberdeen; Paul Raymond Coey, Montrose, both of United Kingdom

[73] Assignee: Astec Developments Limited, Aberdeen, United Kingdom

[21] Appl. No.: 343,478

[22] PCT Filed: May 27, 1993

[86] PCT No.: PCT/GB93/01114

§ 371 Date: Nov. 28, 1994

§ 102(e) Date: Nov. 28, 1994

[87] PCT Pub. No.: WO93/24728

PCT Pub. Date: Dec. 9, 1993

[30] Foreign Application Priority Data

May 27, 1992 [GB] United Kingdom ..... 9211168
Jul. 1, 1992 [GB] United Kingdom ..... 9213983

[51] Int. Cl.[6] ..... E21B 17/10

[52] U.S. Cl. ..... 175/323; 166/241.3; 175/325.3

[58] Field of Search ..... 175/325.3, 323, 175/73, 61; 166/241.3

[56] References Cited

U.S. PATENT DOCUMENTS

| | | | |
|---|---|---|---|
| 1,750,628 | 3/1930 | Crum | 175/346 X |
| 1,848,404 | 3/1932 | Abegg | 175/346 X |
| 2,168,017 | 8/1939 | Hammer | 175/346 |
| 4,040,495 | 8/1977 | Kellner et al. | 175/73 |
| 4,190,123 | 2/1980 | Roddy | 175/325.3 |
| 4,365,678 | 12/1982 | Fitch | 175/323 |
| 4,465,146 | 8/1984 | Fitch | 175/61 |
| 4,880,066 | 11/1989 | Steiginga et al. | 175/107 X |
| 4,958,692 | 9/1990 | Anderson | 175/323 |
| 5,033,558 | 7/1991 | Russo et al. | 175/325.3 |

FOREIGN PATENT DOCUMENTS

| | | | |
|---|---|---|---|
| 66525 | 10/1914 | Austria | 175/325.3 |
| 333450 | 9/1989 | European Pat. Off. . | |
| 334726 | 3/1972 | U.S.S.R. | 175/325.3 |

*Primary Examiner*—Hoang C. Dang
*Attorney, Agent, or Firm*—Ratner & Prestia

[57] ABSTRACT

A downhole tool for providing rotary support of a downhole assembly in which the tool is incorporated, the tool also converting rotary contact with the wellbore to a longitudinal force tending to propel the assembly along the wellbore. The tool resembles a roller stabilizer in which the roller axes are skewed to be tangential to a notional helix, such that the natural (non-slipping) paths of roller contact with the wellbore have a longitudinal component in addition to the usual circumferential path. The tool can be used on drill strings and in downhole motor assemblies. The invention has particular advantage in highly deviated wells since it simultaneously compensates for increased bore friction and dynamically enhances weight-on-bit.

15 Claims, 10 Drawing Sheets

DOWNHOLE TOOLS HAVING CIRCUMFERENTIALLY SPACED ROLLING ELEMENTS

This invention relates to downhole tools, and relates more particularly but not exclusively to downhole tools in the form of well-drilling tools which facilitate the drilling of wells which are substantially non-vertical.

BACKGROUND

As oil and gas reserves become scarcer or depleted, methods for more efficient production have to be developed.

In recent years horizontal drilling has proved to enhance greatly the rate of production from wells producing in tight or depleted formation. Tight formations typically are hydrocarbon-bearing formations with poor permeability, such as the Austin Chalk in the United States and the Danian Chalk in the Danish Sector of the North Sea.

In these tight formations oil production rates have dropped rapidly when conventional wells have been drilled. This is due to the small section of producing formation open to the well bore.

However when the well bore has been drilled horizontally through the oil producing zones, the producing section of the hole is greatly extended resulting in dramatic increases in production. This has also proved to be effective in depleted formations which have been produced for some years and have dropped in production output.

However, horizontal drilling has many inherent difficulties. In broad terms the difficulties include the following factors:

(i) the rotational torque requirement of the drillstring rises rapidly with increasing hole angle (angular displacement from vertical) and length of the horizontal section, (ii) the weight of the drillstring in the vertical section of the hole must push the drillpipe along the horizontal section thereby increasing the fatigue stresses in the drillpipe located on the bend between the two sections, and (iii) performance of the drillbit is reduced due to both (i) and (ii) above as difficulties in applying weight and torque affect the ROP ("rate of progress" in deepening/lengthening of the well).

PRIOR ART

Conventional stabilisers used in assemblies for horizontal drilling do little to resolve the above problems. Conventional stabilisers have fixed blades which normally are spiralled to distribute well contact area whilst still allowing fluid bypass. Conventional stabilisers also generate quite considerable back torque and resistance to forward motion although they do centralise the drilling assembly and play an important role in directional control of the hole.

A number of attempts have been made to reduce friction by the development of rolling element stabilisers. A recent one of these stabiliser tools (described in published European Patent Application EP0333450-A1) used freely rotating balls set into the stabiliser blades which addressed points (i) and (ii) above. initially the tool was well received by the oil industry as there was a real need to resolve the downhole torque problems. Unfortunately the tool proved to have problems with the balls packing off and locking with cutting debris. This considerably reduced the market interest in this tool.

Another known form of rolling element stabiliser is based on rollers mounted on respective axes which are each parallel to the longitudinal axis of the stabiliser and hence parallel to the longitudinal axis of the drillstring and of the well drilled thereby. Examples of this form of roller stabiliser are described in U.S. Pat. 3907048 and United Kingdom Patent Specification GB271839. The functional effect of this form of roller stabiliser is to reduce rotational friction (by reason of the rolling support of the stabiliser against the bore of the well or well casing), but to have a neutral longitudinal effect (by reason of the parallelism of the roller axes with respect to the longitudinal axis of the stabiliser and the drillstring incorporating the stabiliser).

A still further form of rolling element stabiliser which purports to reduce both rotational and longitudinal friction is described in U.S. Pat. No. 1,913,365. This further form of roller stabiliser essentially comprises a collar which is rotatably mounted on the exterior of a drillstring by two rows of vertical-axis rollers, i.e. rollers whose respective axes are each parallel to and radially offset from the longitudinal axis of the drillstring. (These vertical-axis rollers are externally spherically shaped, and therefore superficially appear as balls, although they are actually rollers). While the collar is free to rotate on the drillstring (by reason of the rolling support provided by the vertical-axis rollers), the collar is longitudinally retained at a fixed position on the drillstring by end rings clamped to the drillstring. The collar provides longitudinal rolling support for the drillstring by means of an external array of horizontal-axis rollers, i.e. rollers whose respective axes are each tangential to a circle centered on the longitudinal axis of the drillstring. Thus although this further form of roller stabiliser provides both rotational and longitudinal rolling support for the drillstring, it is to be noted that the purely longitudinal ("vertical") and circumferential ("horizontal") roller axes result in the facts that rotational movement of the drillstring does not result in a net longitudinal force, nor does longitudinal movement of the drillstring result in a net rotational force, i.e. there is no cross-translation of motion and force between rotational and longitudinal directions.

U.S. Pat. No. 4,000,783 describes a roller reamer, i.e. a form of annular drilling bit for substantially enlarging the bore of a pilot hole. In this roller reamer, the conical reamers or cutters are rotatably mounted on respective axes that are each triply offset from the longitudinal axis of the drillstring, being offset radially outwards, obliquely (i.e. conically), and skewed (i.e. helical) with respect to the drillstring axis. The conical reamers enlarge a previously-drilled hole by gouging away the wall of the pilot hole in an annular region around the tool. It is said that if the reamers are disposed at a skew angle which is greater than the neutral skew angle, the cutters provide a self-advancing action. It is to be noted that the conical reamers or cutters of U.S. 4,000,783 provide a purely cutting action, with radial support of this cutting tool being provided by purely static cylindrical shoulders ahead of and behind the cutters (see FIG. 1 of U.S. Pat. No. 4,000,783), a smaller diameter shoulder providing radial support in the pilot hole, and a larger diameter shoulder providing radial support in the enlarged bore. These radial support shoulders are concentric with the longitudinal axis of the tool and of the drillstring.

OBJECTS OF THE INVENTION

It is an object of the invention to provide a downhole tool which provides radial support for a rotatable downhole assembly in a previously drilled hole of substantially uniform diameter, the radial support being provided by a rolling element arrangement which translates rotational movement of the tool to a longitudinal force on the tool.

SUMMARY OF THE INVENTION

According to a first aspect of the present invention there is provided a downhole tool for providing radial support for a rotatable downhole assembly within a previously drilled hole of substantially uniform diameter, said tool comprising a central member constructed or adapted to be incorporated in a rotatable downhole assembly for rotation therewith in use of said tool, said central member mounting a plurality of rolling element means in respective positions which are circumferentially distributed around said tool, each said rolling element means being rotatably mounted on a respective axis which is tangential to a notional helix substantially coaxial with the longitudinal axis of said tool about which said tool rotates in use of said tool such that each said respective axis of said rolling element means is skewed with respect to said longitudinal axis, each said rolling element means having a respective periphery which extends to the radially outermost periphery of said tool whereby the radially outermost periphery of said tool provides rolling radial support for said rotatable downhole assembly in use of said tool by means of the peripheries of said rolling element means and the rotation of said rolling element means about their skewed axes translates rotation of said tool in use thereof to a longitudinally-directed force acting through said central member on said downhole assembly.

Said rotatable downhole assembly may be a drillstring and said notional helix is preferably contra-rotary with respect to the combination of the normal or forward direction of rotation of the drillstring and the direction from said tool towards a drill bit at the downhole end of the drillstring, whereby normal or forward rotation of said drillstring and of the tool incorporated therein results in a longitudinal force tending to propel the drillstring towards the blind end of the bore and ultimately tending to force the drill bit into the geological material to be drilled. Thus if the normal or forward direction of rotation of the drillstring is clockwise as viewed from the surface and looking down into the bore, said notional helix preferably progresses anti-clockwise in a downhole direction therealong whereby the peripheries of said rolling element means, where they extend to the radially outermost periphery of the tool, align with a notional right-hand thread around the outer periphery of said tool.

Each respective axis of said rolling element means is preferably skewed with repict to the longitudinal axis of the tool at an angle in the range from a very low (but non-zero) angle, up to 45°, and more preferably at an angle in the range from 0.5° to 15°. Said downhole tool may incorporate skew angle variation means operable to make the skew angle controllably variable, and possibly capable of reversing the hand of said notional helix whereby the direction of longitudinal force is reversed without reversing the direction of rotation.

Said rolling element means are preferably rollers, and the peripheries of said rollers may individually be cylindrical or crowned (i.e. having relatively larger diameter mid-length portion reducing continuously or discontinuously to a relatively smaller diameter at either end). Said rollers may be individually mounted on a respective axis, or said rollers may be mounted in coaxial groups, preferably such that within a group of rollers, individual rollers of that group are capable of rotating at mutually differing rotational rates.

Radial force applying means are preferably incorporated in the tool for applying radially outwardly directed radial forces to the rolling element means to increase their traction on the bore. The radial force applying means may be such that the radially outwardly directed radial forces applied to the rolling element means are controllably variable.

The central member of the tool may be adapted from a conventional fixed-blade stabiliser by reducing the outside diameter slightly below the nominal diameter of the bore of the well in which the tool is to be used, machining or otherwise forming pockets or recesses in the blades, and mounting a roller assembly in each of these pockets or recesses such that the rollers project to define the gauge or radially outermost periphery of the tool at the nominal well bore diameter. Each roller assembly can comprise a single roller or a group of rollers mounted on an axle which is rotatably mounted at each end thereof by a suitable combination of radial bearings and thrust bearings.

According to a second aspect of the present invention there is provided a rotatable downhole assembly for rotatable operation within a previously drilled hole of substantially uniform diameter, said downhole assembly comprising a downhole motor having a motor housing and a rotatable motor output shaft coupled to a rotatable motor output utilisation means, said downhole assembly further comprising at least one downhole tool according to the first aspect of the present invention, said at least one downhole tool being coupled between said rotatable motor output shaft and said rotatable motor output utilisation means for rotation therewith in operation of said assembly to provide radial support therefor and to translate such rotation to a longitudinally-directed force acting through said motor output utilisation means.

Said downhole assembly may comprise a plurality of such downhole tools, each according to the first aspect of the present invention, and each being coupled between said rotatable motor output shaft and said rotatable motor output utilisation means, said tools being optionally mutually separated by one or more drill collars or other suitable longitudinal spacer means serving in operation of said assembly to convey torque, rotation, and longitudinal forces between parts of said assembly mutually separated by such spacer means.

Said rotatable motor output utilisation means may comprise a drill bit, said at least one downhole tool comprised in said downhole assembly being formed dynamically to increase the effective weight-on-bit during normally directed rotation of said drill bit by said downhole motor.

Said motor housing is preferably coupled to countertorque means for reacting motor torque output by said motor output shaft, said countertorque means rotationally constraining said motor housing with respect to said previously drilled hole. Said countertorque means may provide a rotational braking effect while allowing relative freedom of movement in a longitudinal direction, preferably by forming said countertorque means with a peripheral array of hole-contacting rotatable rollers having their axes of rotation substantially tangential to notional circles substantially coaxial with the longitudinal axis of said downhole assembly. Alternatively, said countertorque means may comprise a further downhole tool in accordance with the first aspect of the present invention, the notional helix of said further downhole tool being oppositely handed with respect to the notional helix of said at least one downhole tool coupled between said rotatable motor output shaft and said rotatable motor output utilisation means whereby relative contrarotation of said motor housing with respect to said motor output shaft results in commonly directed longitudinal forces at said at least one and further downhole tools comprised in said downhole assembly.

The motor of said downhole assembly may be a hydraulic motor supplied in operation thereof with pressurised fluid by way of tubing which may be flexible (i.e., tubing which is known in the art as "coiled tubing"), said downhole assembly preferably being coupled to said tubing by way of a swivel coupling which is preferably substantially fluid-tight.

Said downhole assembly may have major components and sub-assemblies thereof longitudinally coupled by one or more couplings transmissive of torque and longitudinal forces but yieldable about axes transverse to the longitudinal axis whereby the downhole assembly may conform to bent holes.

DESCRIPTION OF EXEMPLARY EMBODIMENTS

Embodiments of the present invention will now be described by way of example, with reference to the accompanying drawings wherein.

Figure 1:
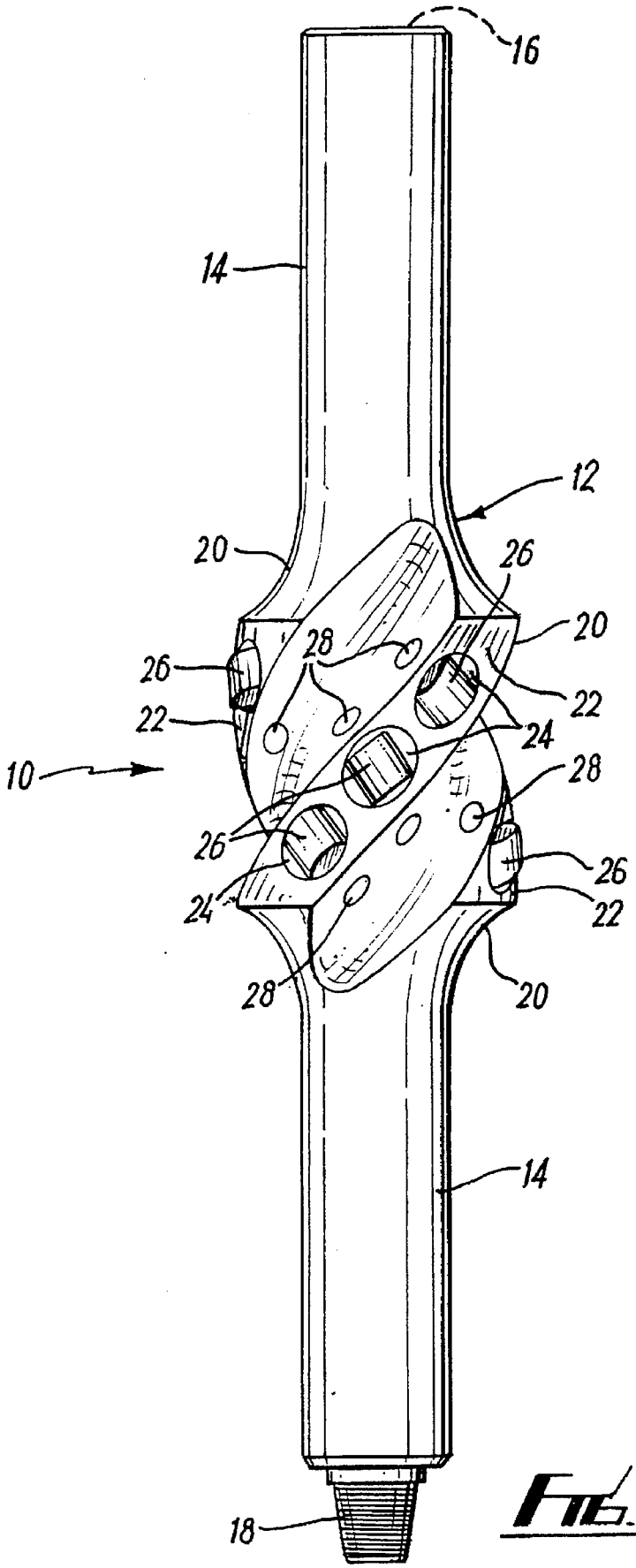
FIG. 1 is an elevational view of a first embodiment of the present invention.

Referring first to FIG. 1, a first embodiment of downhole tool 10 in accordance with the present invention comprises a central member 12 whose form is generally that of a conventional fixed-blade stabiliser. The central member 12 comprises a hollow shaft 14 having a standard A.P.I. (American Petroleum Institute) box connector 16 at the upper end and a standard A.P.I. pin connector 18 at the lower end for connection of the tool 10 in a conventional drillstring (not shown).

The shaft 14 of the central member 12 has three spiral blades 20 formed integrally thereon, each of the blades 20 describing a clockwise helix. The radially outer edge 22 of each blade 20 has a radius (measured from the longitudinal axis of the tool 10) which is slightly less than the nominal gauge of the tool 10, i.e. a radius slightly less than the radius of the bore in which the tool 10 is designed to be used.

Three pockets 24 are cut through each outer edge 22 and into the bodies of the blades 20. Within each pocket 24, a roller 26 is rotatably mounted on a respective axle 28 such that part of the outer periphery of each roller 26 radially extends beyond the respective outer edge 22 of the respective blade 20 to define the radially outermost periphery of the tool 10.

Each of the roller axles 25 is skewed with respect to the longitudinal axis of the tool 10 about which the tool 10 rotates in use thereof, i.e. each roller axle 28 is tangential to a respective notional helix substantially coaxial with the longitudinal axis of the tool 10 and spiralling anti-clockwise in a downward direction (i.e. each notional helix is of opposite hand to the illustrated helical shape of the blades 20). As shown in FIG. 1, the roller axles 28 extend transversely of the blades 20, and therefore a notional point on the outer periphery of any one of the rollers 26 would, as the roller rotated and where the notional point was proud of the respective blade 20, describe a path generally along the line of the outer edge 22 of that blade, i.e. a notional right-hand thread around the outer periphery of the tool 10.

The result of this roller mounting configuration is that the array of rollers 26 provides rolling support for the tool 10, and hence for the drillstring in which it is incorporated, by bearing against the substantially uniform diameter bore of the hole drilled by the drilling bit above which the tool 20 is fitted, while simultaneously reacting with the bore to translate the clockwise rotation of the tool 10 (as viewed from above and looking downhole) into a downwardly-directed longitudinal force by reason of the skewing of each roller 26 as described above. Thus, in normal drilling operations while the drillstring is rotating clockwise (as viewed from above and looking downhole), the tool 10 will cause the drillstring to "walk" downhole, so enhancing the pressure on the drill bit and improving ROP. This beneficial and desirable effect is enhanced by increased side-loading on the tool 10, such as will be experienced as the bore increasingly deviates from vertical, to reach a maximum in horizontal stretches of the bore (where the weight of the horizontal sections of the drillstring is ineffective to push the drill bit forwards). It is also in such deviated and ultimately horizontal stretches of the bore that low-friction radial support of the drillstring is most required, and is provided by the tool 10 simultaneously with the above-described tractive effort.

The skew angle at which each of the rollers 26 is mounted on the tool 10 may be any non-zero angle from a very small angle (e.g., under 1°) up to about 45° (or greater in appropriate circumstances), and is preferably in the range 0.5°–15°. The skew angle is preferably selected to give a greater rate of theoretical progress (as denoted by the pitch of the above-mentioned notional thread) than the maximum ROP practically achievable by the drill bit, such that there is always a forward (downhole-directed) tractive effort during forward (clockwise) rotation of the drillstring.

As is clearly shown in FIG. 1, the rollers 26 are angularly distributed around the periphery of the tool 10, thus tending to give a relatively uniform loading on the bore of the well in which the tool 10 is being used. It should be noted that the well bore will necessarily be of a substantially uniform diameter in those parts of the bore in which the tool 10 is used, since the tool 10 is devoid of any cutting, chiselling, reaming, or gouging action. Indeed, any such reaming action is undesirable, and is avoided at least partly by the suitable distribution of the rollers 26 and by the form of their peripheries (of which more details are given below).

Reversal of the direction of rotation of the drillstring (i.e. rotation of the drillstring in an anti-clockwise direction as viewed from above and looking downhole) will result in concomitant reversal of the above-described longitudinal force to give an uphole-directed tractive effort which will assist in withdrawal of the drillstring from the well. Nevertheless, the desirable low-friction radial support of the drillstring provided by the tool 10 incorporated therein will be maintained even during such reverse rotation.

Figure 2:
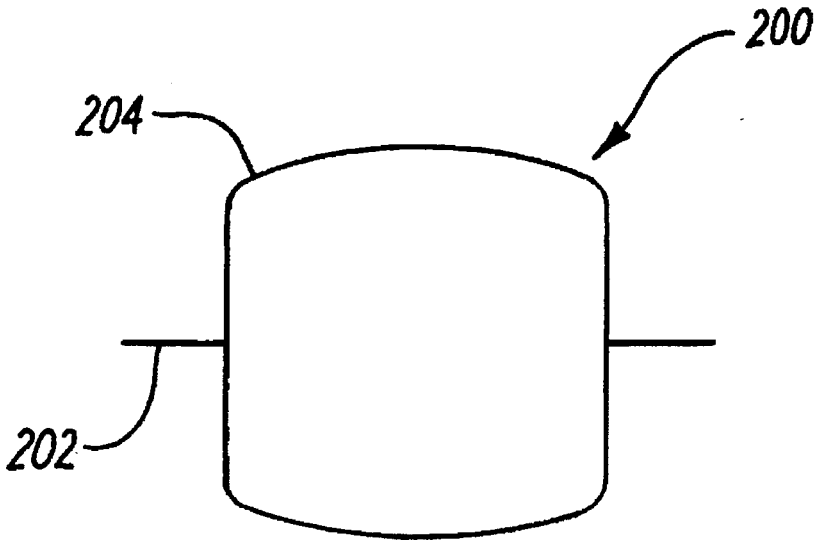
FIG. 2 is an elevational view of a form of roller suitable for use with the present invention.
Figure 3:
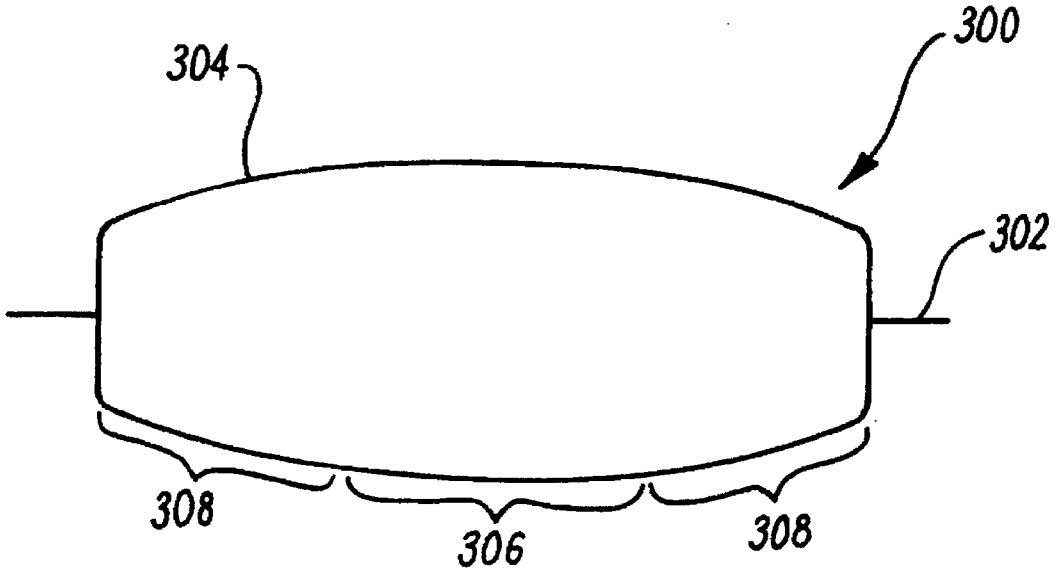
FIG. 3 is an elevational view of another form of roller suitable for use with the present invention.

Referring now to FIGS. 2 and 3, these show two forms of roller suitable for use in the present invention. In FIG. 2, the roller 200 is a crown roller having a (schematically depicted) rotation axis 202. The diameter of the roller periphery 204 varies smoothly (continuously) from a maximum at the mid-length to a somewhat lesser diameter at each end. The length of the roller 200 (as measured along its rotation axis 202) is similar to the maximum diameter of its periphery 204. Crowning of the roller periphery 204 enhances distribution of the loading on the roller 200 in its contact with the bore of the well, as does avoidance of discontinuous changes in peripheral diameter.

In FIG. 3, the roller 300 is a barrel roller having a schematically depicted rotation axis 302. The roller periphery 304 has a mid-length section 306 of substantially constant diameter which merges into conically tapering sections 308 at each end of the roller 300. The length Of the roller 300 (as measured along its rotation axis 302) is a small multiple of the maximum diameter of its periphery 304 (i.e. the diameter of the mid-length periphery section 306).

Figure 4:
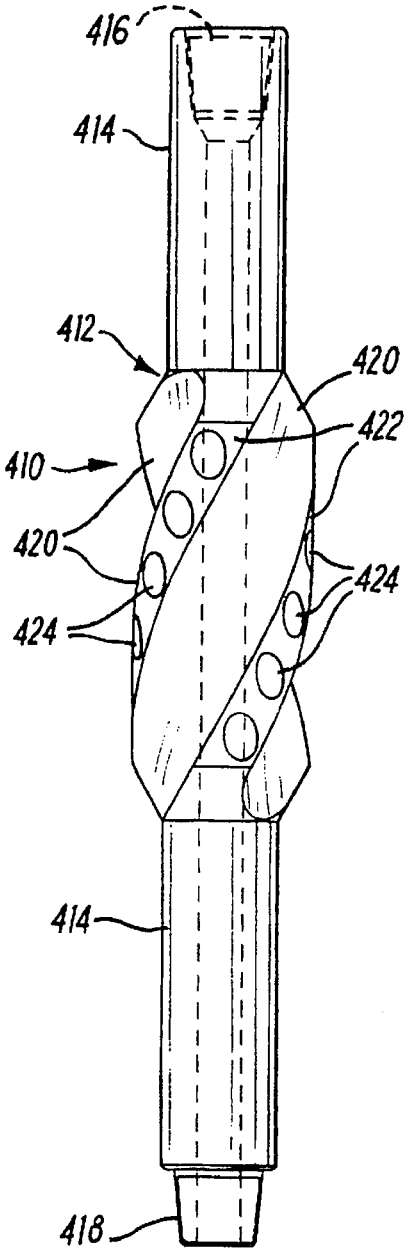
FIGS. 4 and 5 are respectively an elevational view and a plan view of a second embodiment of the present invention.
Figure 5:
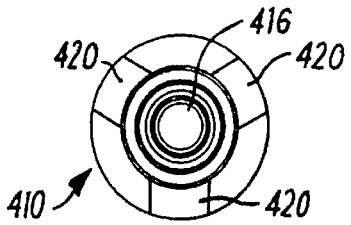

Referring now to FIGS. 4 and 5, these respectively illustrate an elevation and a plan view of a second embodiment of downhole tool 410 in accordance with the present invention. The tool 410 is generally similar to the tool 10 previously described with reference to FIG. 1, and accordingly those parts of the tool 410 which are identical or equivalent to parts of the tool 10 will be given the same reference numerals, but preceded by a "4" (i.e. the FIG. 1 reference numerals plus 400). The following description will concentrate principally on those parts of the tool 410 which differ from the tool 10, and for a detailed description of parts of the tool 410 not described below, reference should be made to the relevant parts of the foregoing description of the tool 10.

Apart from some differences in dimensional proportions (principally an increase in relative lengths), the major difference in the tool 410 with respect to the tool 10 lies in a substantial increase in the numbers of rollers mounted in the periphery of the tool 410. As shown in FIG. 4, a correspondingly increased number of pockets 424 is cut through each outer edge 422 and into the bodies of the blades 420. The rollers mounted one in each of the pockets 424 are omitted from FIGS. 4 and 5, but are similar to the rollers 26 in the tool 10 as shown in FIG. 1; in particular the skewing of the roller axles in the tool 410 is essentially the same as in the tool 10. The performance and functions of the tool 410 are as described above in respect of the tool 10, save for the effects of the increased number of rollers.

Figure 6:
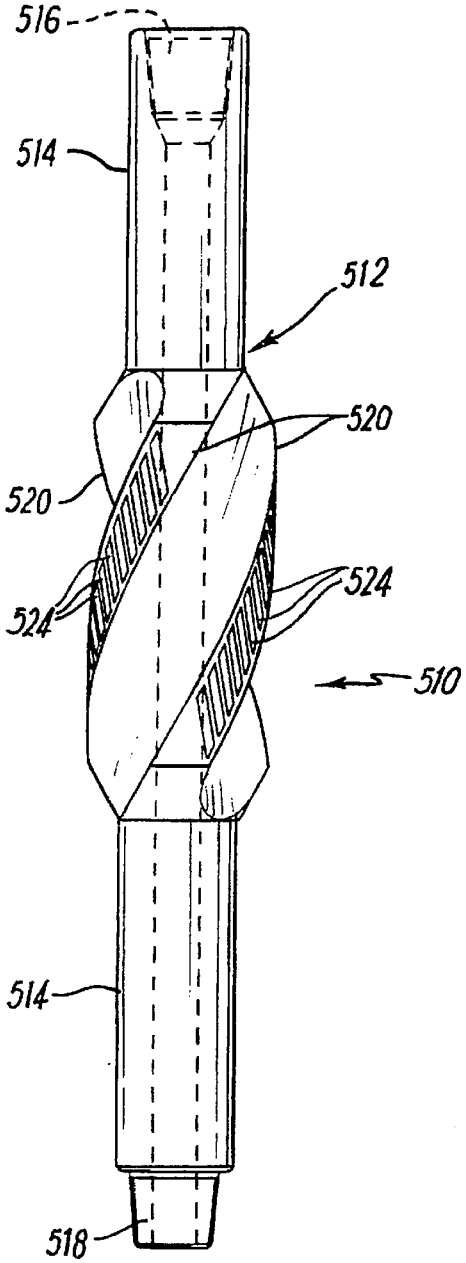
FIG. 6 and 7 are respectively an elevational view and a plan view of a third embodiment of the present invention.
Figure 7:
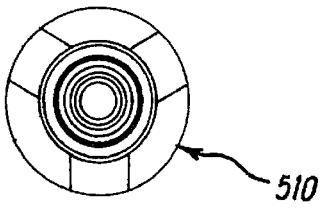

Referring now to FIGS. 6 and 7, these respectively illustrate an elevation and a plan view of a third embodiment of downhole tool 510 in accordance with the present invention. The tool 510 is similar to the tool 410 described above with reference to FIGS. 4 and 5, and accordingly those parts of the tool 510 which are identical or equivalent to parts of the tool 410 will be given the same reference numerals, but with the leading "4" substituted by a "5". The following description will concentrate principally on those parts of the tool 510 which differ from the tool 410, and for a detailed description of parts of the tool 510 not described below, reference should be made to the relevant parts of the foregoing descriptions of the tools 410 and 10.

The major difference in the tool 510 with respect to the tool 410 lies in the replacement of the crown rollers of the second embodiment with a much increased number of needle rollers. Accordingly, the approximately circular roller pockets 424 of the second embodiment are replaced by a correspondingly greater number of relatively narrow roller pockets 524 cut through each outer edge 522 and into the bodies of the blades 520. The needle rollers mounted one in each of the pockets 524 are omitted from FIGS. 6 and 7, but are mounted with their rotation axis each transverse the respective blade 520. Because of the relatively small diameter and relatively great length/diameter ratio of the needle rollers of the third embodiment, it is preferred to mount the needle rollers each in a suitably re-entrant pocket, preferably lined with a suitable bearing material, to retain the rollers in the tool 510, rather than to mount the rollers on individual axles as in the other embodiments of the present invention. Nevertheless, the rotational alignment of each of the needle rollers of the third embodiment is essentially the same as for the rollers of the other embodiments. The performance and function of the tool 510 is the same described above in respect of the tools 10 and 410, save for the effects of the number, size, and shape of the needle rollers.

Figure 8:
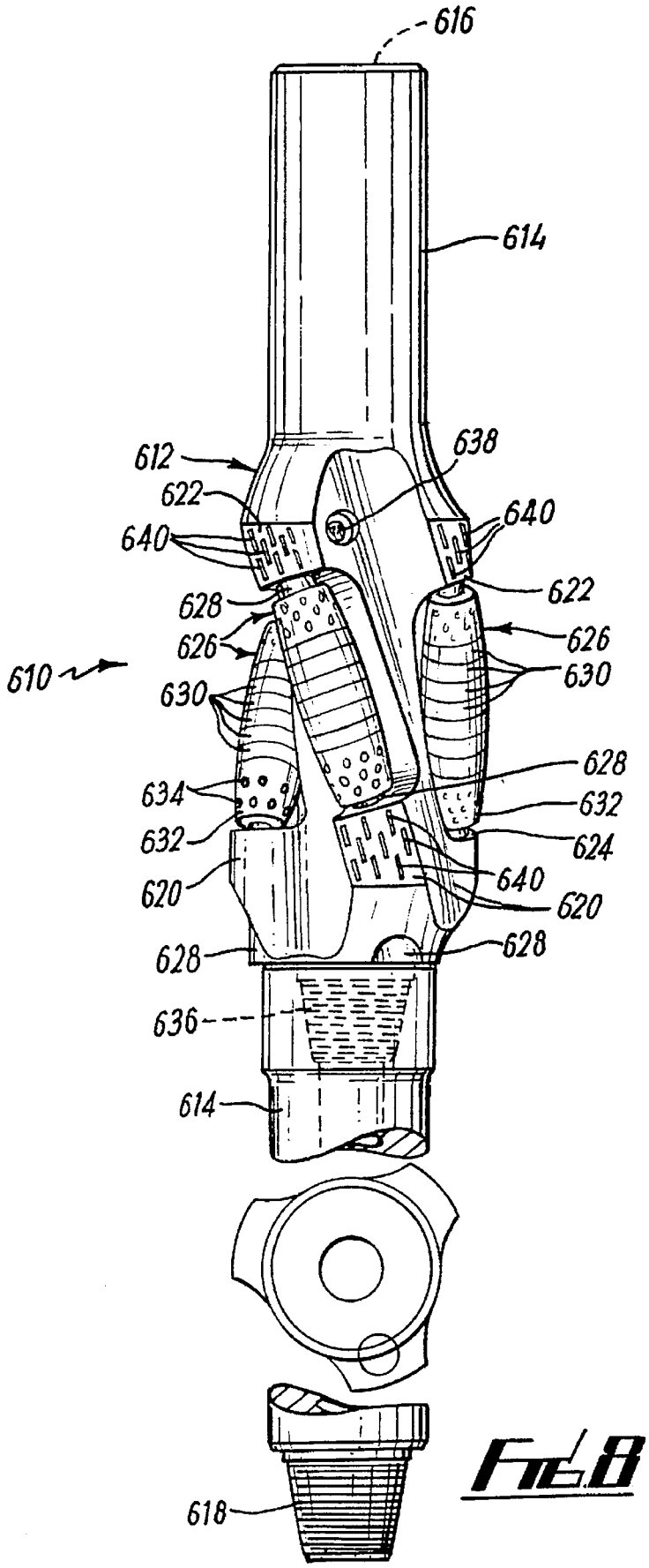
FIG. 8 is an elevational view of a fourth embodiment of the present invention.

Turning now to FIG. 8, this illustrates a downhole tool 610 which is a fourth embodiment of the present invention. The tool 610 comprises a central member 612 which has the form of a fixed-blade stabiliser with a hollow shaft 614 having a standard A.P.I. box connector 616 at the upper end, and a standard A.P.I. pin connector 618 at the lower end for connection of the tool 610 in a conventional drillstring (not shown).

The shaft 614 of the central member 612 has three spiral blades 620 formed integrally thereon, each of the blades 620 describing an anti-clockwise helix or left-handed spiral. (This is in contrast to the blades 20 in the tool 10, which each describe a clockwise helix or right-handed spiral). The radially outer edge 622 of each blade 620 has a radius (measured from the longitudinal axis of the tool 610) which is slightly less than the nominal gauge of the tool 610, i.e. a radius slightly less than the radius of the bore in which the tool 610 is designed to be used.

A recess 624 is cut from the outer edge 622 and into the body of each blade 620. Within each pocket 624, a roller assembly 626 is rotatably mounted on a respective axle 628 such that part of the outer periphery of each roller assembly 626 radially extends beyond the respective outer edge 622 of the respective blade 620 to define the radially outermost periphery of the tool 610.

Each of the roller assembly axles 628 is skewed with respect to the longitudinal axis of the tool 610 about which the tool 610 rotates in use thereof, i.e. each roller assembly axle 628 is tangential to a respective notional helix substantially coaxial with the longitudinal axis of the tool 610 and spiralling anti-clockwise in a downward direction (i.e. each notional helix is of the same hand as the illustrated helical shape of the blades 620, and in a preferred form of the fourth embodiment, each notional helix is substantially coincident with the center-line of the respective helical blade 620). As shown in FIG. 8, the roller assembly axles 628 extend longitudinally of the blades 620, and therefore a notional point in the outer periphery of any one of the roller assemblies 626 would, as the roller assembly rotated and where the notional point was proud of the respective blade 620, describe a path generally transverse the outer edge 622 of that blade, i.e. a notional right-hand thread around the outer periphery of the tool 610.

Each of the roller assemblies 626 comprises a group of rollers 630 coaxially mounted side-by-side along the respective axle 628 such that each roller 630 can individually rotate independently of its neighbors, thereby permitting traction without slippage due to differential rotational velocities along the roller assembly 626. The overall profile of each roller assembly 626 is ellipsoidal or hyperboloidal to suit the circumferential curvature of the well bore in which the tool 610 is used, in conjunction with the selected skew angle of the axles 628 (this skew angle preferably being in the range 0.5°–15°, and possibly up to about 45°). End sections 632 of the roller assemblies 626 may be peripherally faced with wear-resisting inserts 634 (e.g. of tungsten carbide).

Opposite ends of each roller assembly axle 628 are housed in uncutaway portions of the body of the respective blade 620 wherein radial loading on the respective axle 628 is sustained by radial bearings, and axial loading is sustained by suitable axial bearings. In order to give access to a longitudinal axle-accommodating bore through the body of each blade 620 from the lower end face thereof, the shaft 614 of the central member 612 is made in two parts mutually connected by a standard A.P.I. pin and box connector 636 (shown in ghost outline) joining the two shaft parts immediately below the lower end faces of the blades 620.

Each roller assembly axle bearing arrangement may be provided with a pressure-compensated grease reservoir 638 (only one being visible in FIG. 8) to provide lubrication therefor in a manner which inhibits the ingress of drilling debris and other foreign material.

The portions of the blade edges 622 not cut away to form the roller assembly recesses 624 may be faced with wear-resisting inserts 640 (e.g. of tungsten carbide) to mitigate the effects of unintended direct contact of the blade edges 622 with the well bore, such as may occur in the event of excessive wear of the roller assemblies 626 or collapse of their axles 628 or of their bearings.

Normal operation of the downhole tool 610 is as described above in respect of the downhole tool 10.

Figure 9:
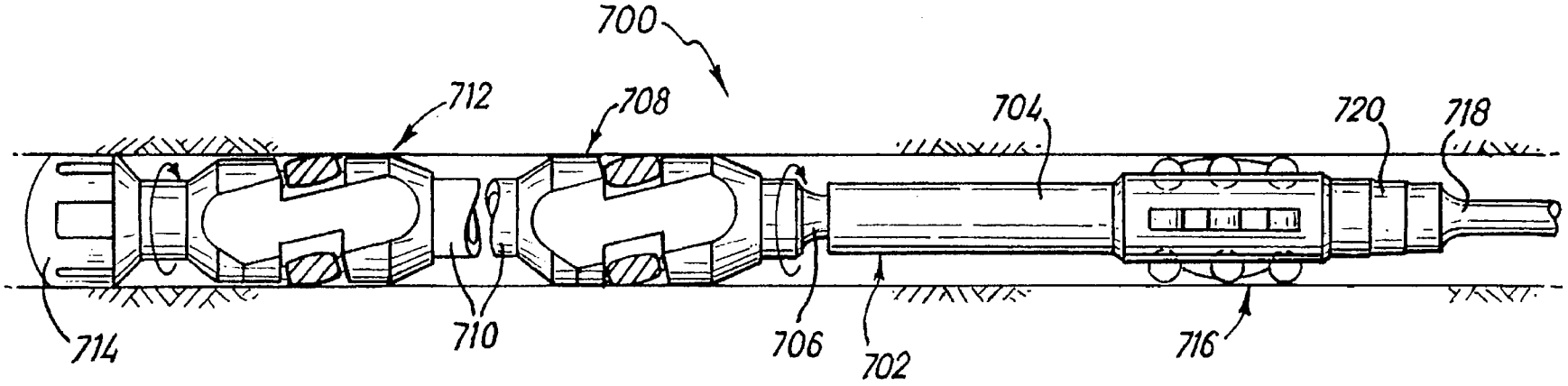
FIG. 9 is a schematic longitudinal elevation of a fifth embodiment of the present invention.

Referring now to FIG. 9, this schematically depicts a longitudinal elevation of a downhole assembly 700 in accordance with the present invention. The assembly 700 comprises a downhole motor 702 having a motor housing 704 and a rotatable motor output shaft 706. The motor shaft 706 is coupled through a first downhole tool 708, a drill collar 710 (only the ends of which are shown), and a second downhole tool 712 to a drill bit 714.

Each of the tools 708 and 712 is similar to the previously described downhole tools 10, 410, & 610 in having three skew-axis rollers mounted around its periphery to provide radial support for the downhole assembly 700, and to translate rotary motion during use of the assembly 700 into a longitudinal force acting on the drill bit 714 to increase its effective weight-on bit.

The motor housing 704 is coupled to and radially supported by a roller assembly 716 having a peripheral array of rollers each having their rotation axis tangential to a notional circle coaxial with the longitudinal axis of the assembly 700 (equivalent to one of the previously described downhole tools but with a skew angle of 90°, or somewhat like the outer part of the "antifriction bearing" of U.S. Pat. No. 1,913,365). The effect of the roller assembly 716 is to provide countertorque for the motor 702, i.e., to inhibit anticlockwise rotation of the motor housing 704 while the motor output shaft 706 is being driven clockwise by operation of the motor 702. This countertorque is achieved by the circumferential alignment of the roller axes in the roller assembly 716, which prevents free rotation of the roller assembly 716 (though some limited rotation may take place due to slippage), though longitudinal movement of the roller assembly 716, and hence of the downhole assembly 700, can take place relatively freely.

The motor 702 is a hydraulic motor of the Moineau type which is fed with pressurised hydraulic fluid through a flexible tube 718 of the type known as "coiled tubing". The tube 718 is linked to the downhole assembly 700 through a fluid-tight rotary swivel 720 to prevent rotation of the motor casing 704 (due to slippage of the roller assembly 716) inducing undesirable distortions in the tube 718.

Figure 10:
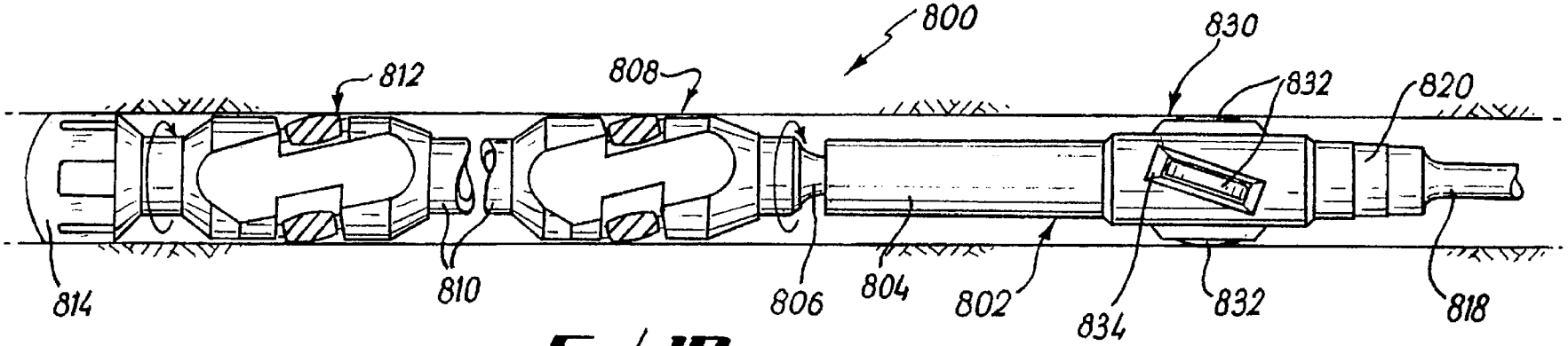
FIG. 10 is a schematic longitudinal elevation of a sixth embodiment of the present invention.

Turning now to FIG. 10, this shows a downhole assembly 800 which is similar in many aspects to the above-described assembly 700, but which differs in one substantive respect (detailed below). Those parts of the assembly 800 which are identical to or equivalent to like parts of the assembly 700 are given the same reference numeral, but with the leading "7" substituted by an "8" Therefore, for a full description of any part of the assembly 800 not detailed below, reference should be made to the appropriate part of the foregoing description of the assembly 700.

The substantive difference in the downhole assembly 800 with respect to the downhole assembly 700 consists in replacing the roller assembly 716 with a further downhole tool 830 which is essentially similar to the downhole tools 808 and 812, except that the hand of the notional helix is reversed, i.e. each roller 832 is mounted on a respective roller axle 834 which is tangential to a notional helix substantially coaxial with the longitudinal axis of the tool 830 and spiralling clockwise ("right hand") in a downward direction (right to left as viewed in FIG. 10). The effect of this roller pitch reversal in the tool 830 with respect to the anticlockwise ("left hand") roller pitch in the tools 808 and 812 is that as the motor housing 804 contrarotates (anticlockwise as viewed from above) as a consequence of reacting the clockwise output torque of the motor output shaft 806, the tool 830 produces a longitudinal force acting in a downward direction (right to left as viewed in FIG. 10), thus dynamically adding to the effective "weight" on the drill bit 814.

The tool 830 is preferably set up and adjusted so that the tool 830 is less susceptible to longitudinal slippage than the tools 808 and 812. As well as the adoption of slippage-reducing measures such as providing the rollers 832 with high-grip surfaces, such an objective can be attained by additionally or alternatively urging the rollers 832 radially outwards of the tool 830, e.g. by mounting the roller axles 834 on springs (not shown) arranged to force the axles 834, and the rollers 832 mounted thereon, radially outwards of the tool 830; alternatively the axles 834 could be mounted on pressurizable actuators (not shown), e.g. hydraulic piston and cylinder assemblies, disposed to force the axles 834 and the rollers 832 thereon radially outwards of the tool 830 when suitably pressurised. Spring enhancement of roller traction forces (i.e. radial outward forces) has the advantage of being continuous and automatic, while hydraulic or other pressure enhancement of roller traction forces is capable of being suitably controlled in respect of factors such as timing and magnitude, thus enabling better performance of the downhole assembly 800 in operation thereof.

Dominance by the tool 830 over the tools 808 and 812 in terms of their respective contributions to the production of longitudinal forces in a common downhole direction can be further assured by making the tools 808 and 812 undergauge, i.e. by arranging their roller axle locations and/or the roller diameters to make the overall outside diameter of the tools 808 and 812 marginally less than the bore of the previously drilled hole in which the downhole assembly 800 is operated.

The tools 808 and 812 not only function to provide a dynamically increased weight-on-bit (as previously detailed), the tools 808 and 812 additionally function as stabilisers, i.e. they function to provide radial support for the parts of the downhole assembly 800 between and including the motor shaft 806 and the drill bit 814, allowing relatively low-friction rotation of these components by reason of the rollers forming the peripheries of the tools 808 and 812. Thus the dual-function tools 808 and 812 may conveniently be termed "traction stabilisers". Similarly, the tool 830 can be termed the "dominating stabiliser".

In the FIG. 10 arrangement, the negative effects of the reaction torque of the motor 802 will be utilized to positive effect, providing an additional thrust or motive force to that of the traction stabilisers 808 and 812.

As the motor output shaft 806 rotates providing torque to the drill bit 814, the traction stabilizers 808 and 812 provide forward thrust due to their ability to "walk" into the wellbore under the influence of the left-hand flutes incorporating the tractive rolling elements. The pitch of the left-hand helix will be constructed in such a way that the traction stabilizers 808 and 812 will attempt to "walk" into the wellbore faster than either the coil-tubing 818 can be unreeled into the wellbore, or the drill bit 814 can cut into fresh formation. This situation creates slippage between the traction stabilizers 808, 812 and the wellbore.

However, although the motor 802 will provide nominally constant rpm to the drilling assembly, the fact that the dominating stabilizer 830 is configured to reduce the opportunity for slippage will cause a change in the relative rotational speeds of the motor rotor 806 and motor casing 804 with respect to the wellbore. It is envisaged that the motor casing 804 will slow down in direct proportion to the reduction in forward motion from the calculated on the basis of the helix angle. The reduced rotational speed of the motor casing 804 will be compensated by an increase in the rotational speed of the rotor 806, thereby providing the same thrust to the drill bit 814, irrespective of the rotational fluctuations of the assembly 800. In short, this system will provide automatic compensation of the weight-on-bit longitudinal thrust provided at the drill bit 814.

To illustrate more fully and clearly the mechanism of operation the following numerical illustration is shown by way of example, although the figures given are not mandatory in every case.

Given that the best operation of typical coil-tubing is RIH ("run into hole") @1000 ft/hr it is imperative that the motive force provided by the traction stabilizers is configured for significantly more longitudinal progress than this.

1000 ft/hr=0.28 ft/sec 5 miles/hr=7.33 ft/sec

In effect this means that the traction stabilizers would "walk" downhole at 7.33 ft/sec but are constrained to 0.28 ft/sec, roughly 4% of their capability. The remaining capability must therefore be dissipated as slippage between the traction stabilizers and the wall of the wellbore.

If the motor 802 is designed to operate at 400 rpm, and uses 300 rpm to drive the rotor 806 (and therefore the traction stabilizers 808 and 812) the remaining 100 rpm would be seen at the motor casing/dominating stabilizer interface.

Given that the dominating stabilizer 830 will not slip, the rotational speed of the motor casing 804 will reduce from 100 rpm to 4 rpm, to compensate for the reduction in forward motion of the stabilizers 808 and 812, in direct proportion. Equally, the remaining 96 rpm will now transfer to the motor's rotor 806, and its shaft speed can be transferred back and forth between the rotor 806 and the casing 804 to provide a constant thrust to the drill bit 814.

It is possible that due to the very shallow angles involved in the setting of the left-hand stabilizers 808 and 812 that a mechanism can be developed which inverts the orientation of the flutes and hence the helix angle of the rollers such that for a continued input rotation the downhole assembly would now "walk" back out of the hole.

Figure 11:
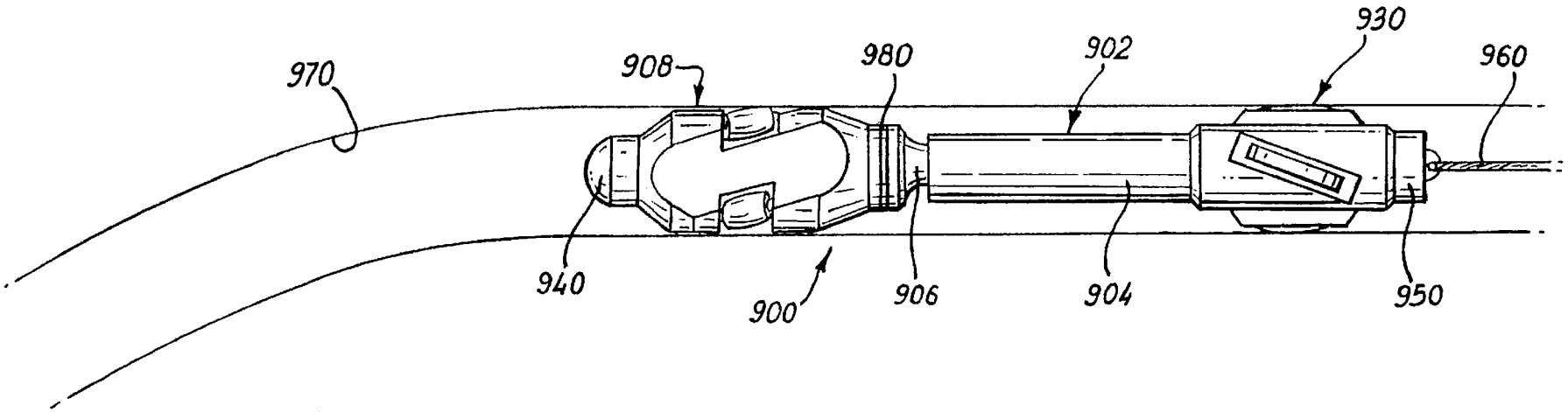
FIG. 11 is a schematic longitudinal elevation of a seventh embodiment of the present invention.

Referring now to FIG. 11, this schematically illustrates a downhole assembly 900 which is a modification of the assembly 800 described above with reference to FIG. 10. The assembly 900 is configured to function as a pipe crawler or pipe tug assembly capable of pulling pipes, cables, inspection and testing equipment, and the like along tunnels, conduits, and similar underground passages that have been formed prior to the passage of the assembly 900. Those parts of the assembly 900 which correspond to equivalent or analogous parts of the assembly 800 are given the same reference numeral, but with the leading "S" replaced by a "9"; reference should be made to the appropriate parts of the preceding description for details of any part of the assembly 900 not described below.

In the assembly 900, items forward (downhole or leftwards as viewed in FIG. 11) of the tool/stabilizer 908 are removed and replaced by a bull-nose 940. The rear or uphole end of the assembly 900 is fitted with a cable attachment 950 to which (for example) a cable 960 may be attached to be dragged through the bore 970 by means of the assembly 900.

The motor 902 would drive the traction stabiliser 908 which would "walk" along the pipe or conduit 970. The dominating stabilizer 930 would be configured to drag the cable 960 behind is as the assembly 900 rotated and moved along the pipe 970. To obviate the difficulties encountered at a bend in the pipe 970 it is envisaged that the pipe tug assembly 900 would have a universal coupling 980 (e.g. a Hooke joint) between the motor 902 and the traction stabiliser 908, thereby enabling the assembly 900 to negotiate bends until limited by radii smaller than the longest section length of the pipe tug. assembly 900.

It is also preferred that the aforementioned mechanism to reverse the helix angle of the tractive elements 908 and 930 is included in the assembly 900. This would enable the traction stabilizer to "walk" out of the pipe for the same given rotation.

Figure 13:
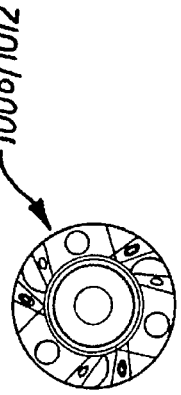
FIGS. 12 and 13 are respectively an elevational view and a plan view of an eighth embodiment of the present invention.
Figure 12:
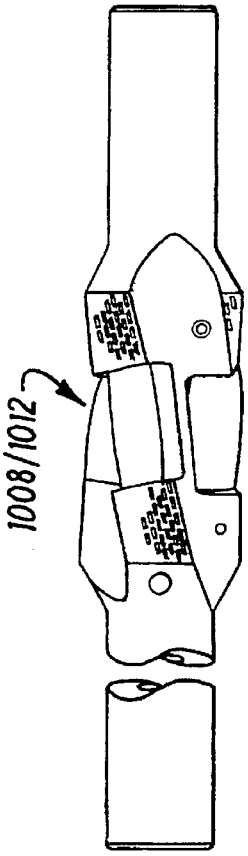
Figure 14:
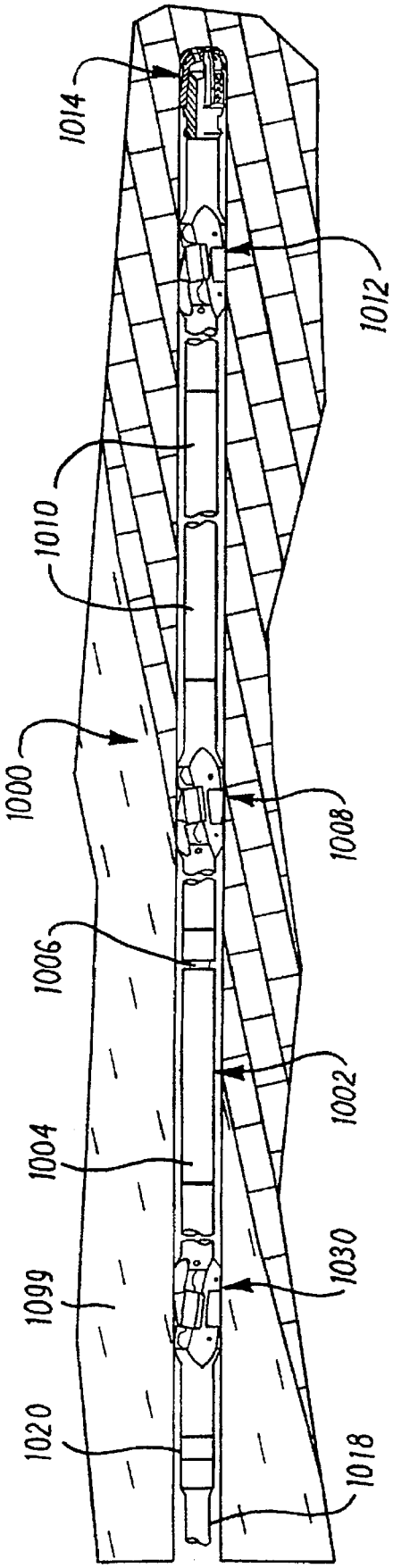
FIG. 14 is a schematic longitudinal elevation of a ninth embodiment of the present invention.

FIGS. 12–14 show a downhole drilling assembly 1000 essentially similar to the downhole assembly 80 of Fig. 10, but in more detail and somewhat less schematically. Parts of the assembly 1000 which directly correspond to parts of the assembly 800 are given the same reference numerals, but with the leading "8" replaced by "10" (e.g., in FIG. 14, the motor which is equivalent to the motor 802 of FIG. 10 is denoted "1002"). For a detailed description of the parts of the assembly 1000 and their operation, reference should be made to the foregoing description of the equivalent parts of the assembly 800 and their operation.

FIG. 12 is an elevational view of either one of the mutually identical downhole tools or traction stabilizers 1008 and 1012, while FIG. 13 is a plan view from above of the traction stabilisers 1008, 1012 (i.e. a view from the left in FIG. 14 wherein the assembly 1000 is oppositely oriented to the assembly 800 as depicted in FIG. 10). FIG. 14 is an elevation of the assembly 1000 drilling through geological material 1099 (in a direction from left to right as viewed in FIG. 14). Operation of the assembly 1000 and of its constituent parts is as previously described in respect of the assembly 800 (FIG. 10).

Figure 15:
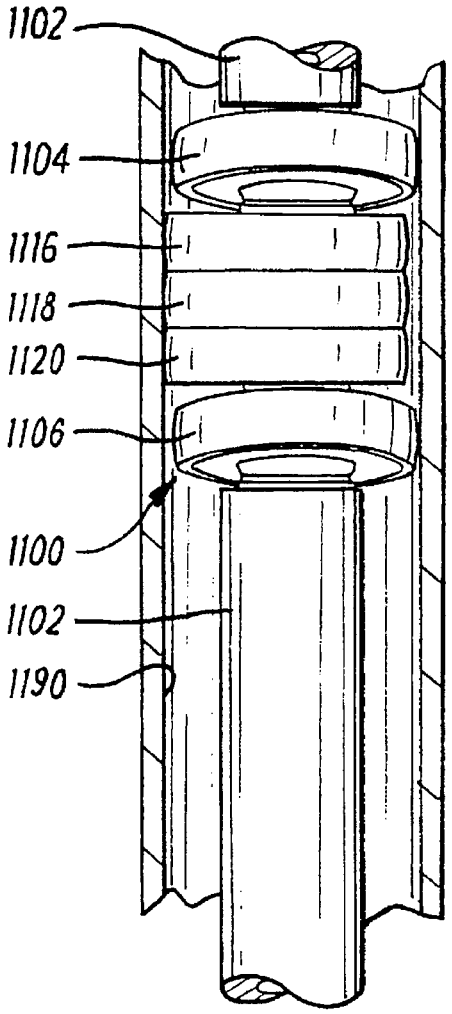
FIGS. 15 and 16 are elevational views of a tenth embodiment of the present invention, taken in mutually orthogonal directions.
Figure 16:
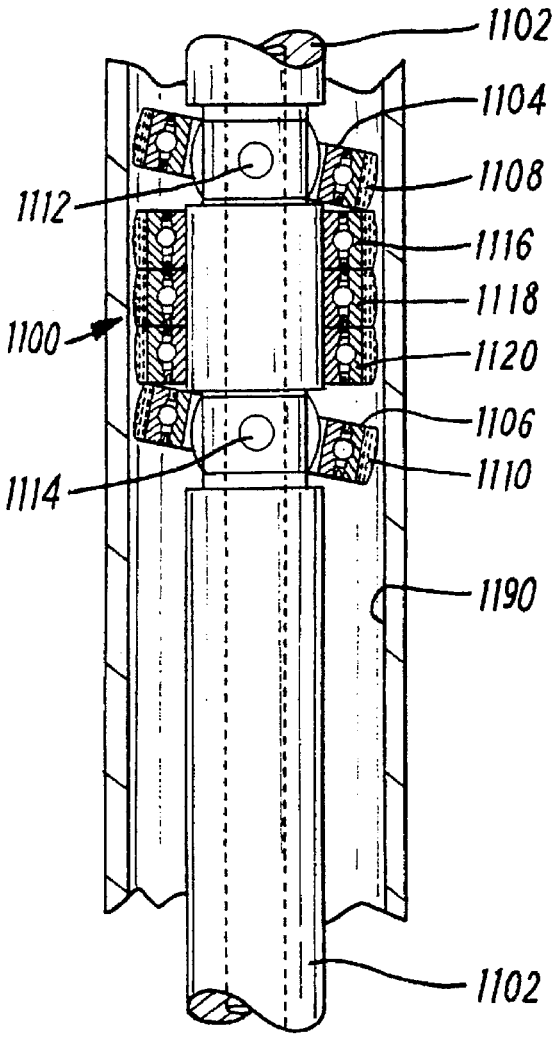

FIGS. 15 and 16 illustrate a. downhole tool which is a variation on the previously described downhole tools. FIG. 15 is a longitudinal elevation of the outline of the tool 1100 in an operational position within the tubular casing 1190, while FIG. 16 is a longitudinal section of the tool 1100 taken on a plane which is vertical to the center line of FIG. 15, and viewed in a direction which is right to left in FIG. 15.

In the previously described downhole tools, the rollers or other rolling elements had individual diameters which were small relative to the overall peripheral diameter of the tool. However, the tool 1100 differs in that the rolling elements (detailed below) have individual diameters which are more nearly equal to (though still less than) the overall peripheral diameter of the tool.

Referring specifically to FIG. 16, the tool 1100 comprises a tubular central member 1102 upon which are mounted two spaced-apart single-row ball bearings 1104 and 1106 each fitted with respective toughened tyre 1108, 1110 formed of metal, polymer, or any other suitable material.

Each of the bearings 1104 and 1106 is mounted on a respective tilt bearing 1112 and 1114 whose mutually parallel rotational axes are each diametrically aligned with respect to the longitudinal axis of the central member 1102. The bearing 1104 and 1106 are coupled by means (not shown) for controllable conjoint tilting in parallel planes about their respective tilt bearings 1112, 1114 such that each of the bearings 1104, 1106 rotates about a respective axis which is angularly skewed with respect to the longitudinal axis of the central member 1102. These rotation axes of the bearings 1104 and 1106 are also laterally offset from the longitudinal axis, in a direction which is upwards from the plane of FIG. 16, and rightwards in FIG. 15.

Between the mutually longitudinally spaced-apart bearings 1104 and 1106, the central member 1102 mounts a cluster of three mutually coaxial bearings 1116, 1118, and 1120 each dimensionally identical to the bearings 1104 & 1106, and each likewise being fitted with a respective toughened tyre. Each of the ball bearing 1116, 1118 and 1120 rotates about the same rotation axis which is parallel to the longitudinal axis of the central member 1102 (i.e. rotation axis is non-skewed), and laterally offset equally and oppositely to the lateral offset of the rotation axes of the bearings 1104 and 1106, i.e. the common rotation axis of the bearings 1116, 1118, and 1120 is displaced in a direction which is downwards from the plane of FIG. 16, and leftwards in FIG. 15.

Thus the bearing pair 1104, 1106, and the bearing triplet 1116-1120 contact mutually opposite sides of the casing 1190, as most clearly shown in FIG. 15, thus to provide mutually opposed radial forces causing these bearing groups each to bear against the inner face of the casing 1190. The skew angle of the bearing pair 1104 and 1106 results in a longitudinal force being developed as the tool 1100 rotates within the casing 1190, this longitudinal force being directed upwards as viewed in FIGS. 15 and 16 when the direction of rotation is clockwise as viewed from above and looking downwards.

Figure 17:
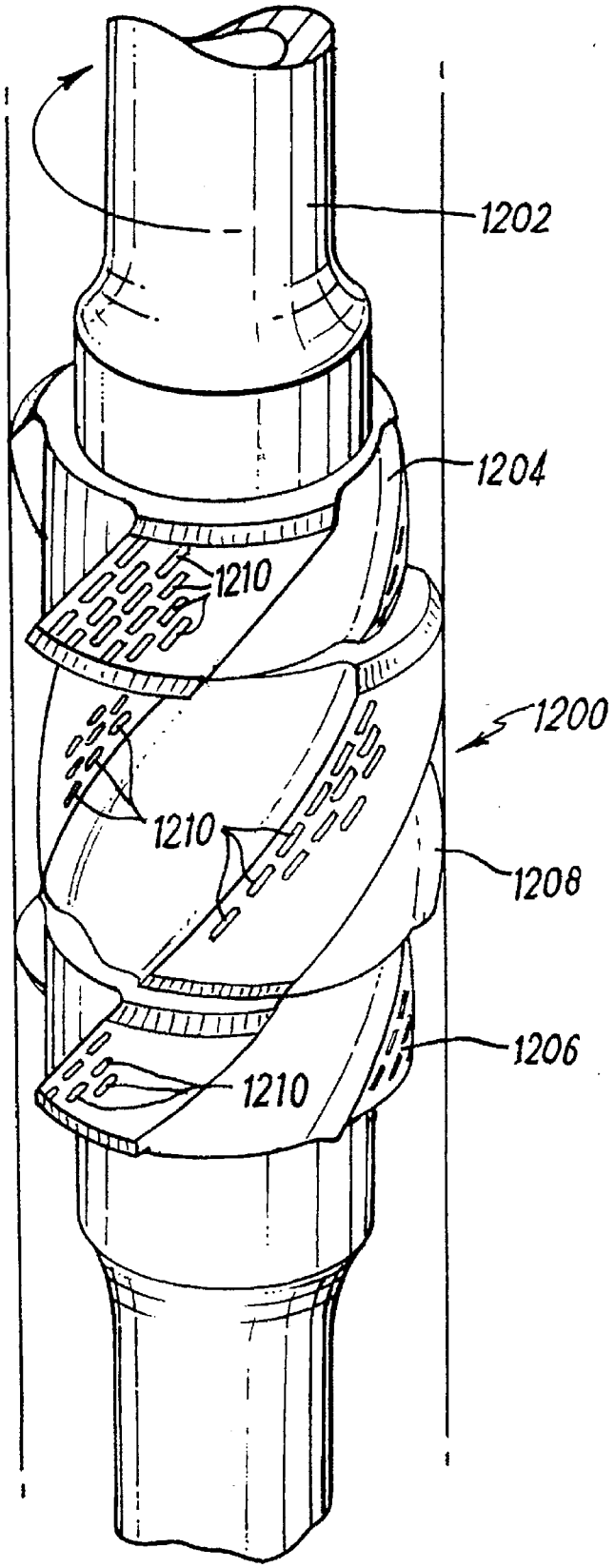
FIG. 17 is a perspective view of an eleventh embodiment of the present invention.

FIG. 17 is a perspective view of a downhole tool 1200 based on the "large roller" principle described above with reference to FIGS. 15 and 16. In the tool 1200, a central tubular member 1202 rotatably mounts upper and lower rollers 1204 and 1206 on respective rotation axes which are angularly skewed with respect to and laterally offset from the longitudinal axis of the tool 1200, as described above in respect of the rollers 1104 and 1106 in the downhole tool 1100 of FIGS. 15 and 16. The central member 1202 also rotatably mounts a central roller 1208 on a respective rotation axis which is laterally offset from the longitudinal axis of the tool 1200 by an amount equal to and in a direction opposite to the lateral offset of the rotation axes of the upper and lower rollers 1204 and 1206. The rotation axis of the central roller 1208 may be parallel to the longitudinal axis, or it may be skewed to match the skew of the rotation axes of the upper and lower rollers 1204 and 1206. Means (not shown) may be incorporated into the tool 1200 to cause the rollers 1204, 1206, and 1208 to be mechanically and/or hydraulically urged radially outwards in a controlled or uncontrolled manner against the bore of the casing or other tubular cavity within which the tool 1200 is being operated. Further means (not shown) may be incorporated into the tool 1200 for controllably varying the skew angles of the rollers. The rollers 1204, 1206 and 1208 preferably incorporate peripheral inserts 1210 of a hard wear-resistant material (e.g. tungesten carbide), the rollers thereby superficially resembling 'slices' of a conventional hard-faced fixed-blade stabiliser.

Figure 19:
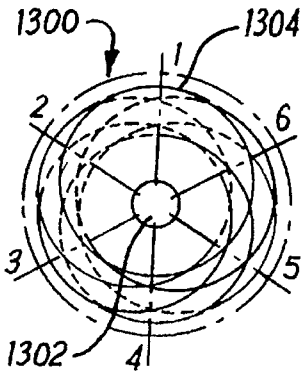
FIGS. 18 and 19 are respectively schematic elevational and plan views of a twelfth embodiment of the present invention.
Figure 18:
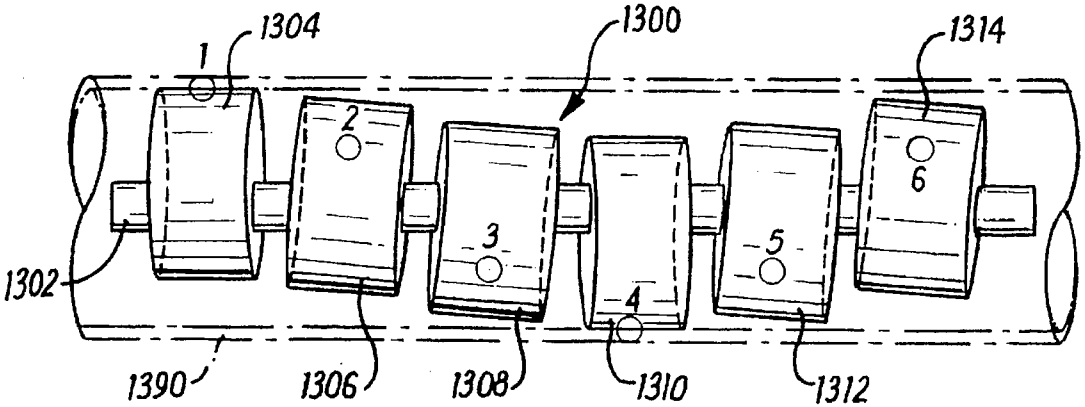

FIGS. 18 and 19 are respectively a schematic elevation and an end view illustrating a developed form of a "large roller" downhole tool based on the above described principles. In the downhole tool 1300 as schematically depicted in FIG. 18, a longitudinally extending central member 1302 mounts six large diameter rollers 1304, 1306, 1308, 1310, 1312, and 1314 at spaced-apart locations along the central member 1302. Each of the rollers 1304–1314 has a respective rotation axis which is both laterally offset and angularly skewed with respect to the longitudinal axis of the central member 1302, i.e. the center line of the tool 1300, as depicted in FIG. 19. As shown in FIG. 18, the rollers 1304–1314 have equal increments of mutual angular displacement of their respective lateral offsets, but this is not actually essential, the requirement being that the lateral offsets be angularly distributed in the tool as a whole such as to provide a net balance of radial forces, i.e. such that a force in any one radial direction is balanced by a diametrically opposed radial force (or resultant of two or more radial forces).

Each of the rollers 1304–1314 contacts the surrounding casing 1390 at a respective point of contact (labelled "1"–"6" in FIG. 18) at which the circumference of the respective roller makes a small angle (equal to the skew angle) with respect to a purely circumferential direction around the bore of the casing 1390 at that point, such that if the tool 1300 rolled around inside the casing 1390 without slipping, these points of contact would trace out paths equivalent to a screw-thread around and along the base of the casing. Thus at the same time as the tool 1300 provides rotational support for a downhole assembly of which it forms part, rotation of the tool 1300 tends to develop a longitudinal force driving the tool along the casing.

Figure 21:
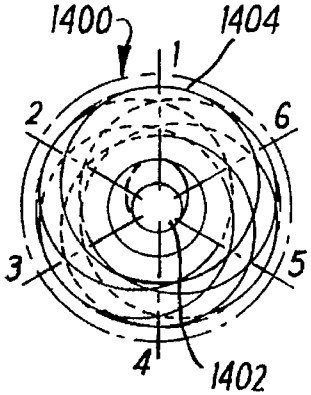
FIGS. 20 and 21 are respectively schematic elevational and plan views of a thirteenth embodiment of the present invention.
Figure 20:
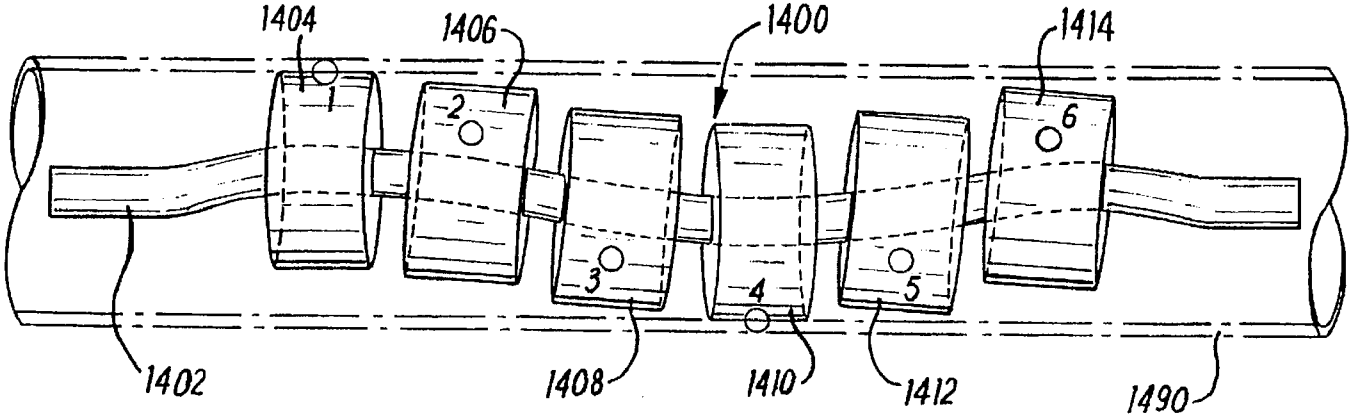

FIG. 20 (elevation) and FIG. 21 (plan) schematically depict a downhole tool 1400 which is a modification of the tool 1300 described above with reference to FIGS. 18 and 19. In FIGS. 20 and 21, these parts of the modified tool 1400, which are equivalent or analogous to parts of the tool 1300 are given the same reference numerals, but with the leading "13" replaced by a "14"; for a description of any part of the tool 1400 not detailed below, reference should be made to the relevant part of the preceding description of the tool 1300.

In the tool 1400, the central roller-mounting 1402 has the general form of a helix, each of the rollers 1404–1414 being centrally mounted on the helical member 1402 such that the required combination of lateral offset and skew angle for each of the rollers 1404–1414 is provided by the helical displacement of the member 1402 from the longitudinal axis of the tool 1400, rather than by offsetting the individual mounting of each roller as in the FIG. 19 arrangement. The tool 1400 functions in the same manner as does the tool 1300.

While certain modifications and variations of the invention have been described above, the invention is not restricted thereto, and other modifications and variations can be adopted without departing from the scope of the invention as defined in the appended claims.

We claim:

1. A rotatable downhole assembly for rotatable operation within a previously drilled hole of substantially uniform diameter, said downhole assembly comprising a downhole motor having a motor housing and a rotatable motor output shaft coupled to a rotatable motor output utilisation means, said downhole assembly further comprising at least one downhole tool for providing radial support for a rotatable downhole assembly within a previously drilled hole of substantially uniform diameter, said tool comprising a central member constructed or adapted to be incorporated in a rotatable downhole assembly for rotation therewith in use of said tool, said central member mounting a plurality of non-reaming, non-cutting rolling element means in respective positions which are circumferentially distributed around said tool, each said rolling element means being rotatably mounted on a respective axis which is tangential to a notional helix substantially coaxial with the longitudinal axis of said tool about which said tool rotates in use of said tool such that each said respective axis of said rolling element means is skewed with respect to said longitudinal axis, each said rolling element means having a respective periphery which extends substantially along the radially outermost periphery of said tool whereby the radially outermost periphery of said tool provides rolling radial support for said rotatable downhole assembly in use of said tool by means of the peripheries of said rolling element means and the rotation of said rolling element means about their skewed axes translates rotation of said tool in use thereof to a longitudinally-directed force acting through said central member on said downhole assembly, said at least one downhole tool being coupled between said rotatable motor output shaft and said rotatable motor output utilisation means for rotation therewith in operation of said assembly to provide radial support therefor and to translate such rotation to a longitudinally-directed force acting through said motor output utilisation means, wherein the motor of said downhole assembly is a hydraulic motor supplied in operation thereof with pressurised fluid by way of tubing, said downhole assembly being coupled to said tubing by way of a swivel coupling which is substantially fluid-tight.

2. A downhole tool as claimed in claim 1 wherein said rotatable downhole assembly is a drillstring and said notional helix is contra-rotary with respect to the combination of the normal or forward direction of rotation of the drillstring and the direction from said tool towards a drill bit at the downhole end of the drillstring, whereby normal or forward rotation of said drillstring and of the tool incorporated therein results in a longitudinal force tending to propel the drillstring towards the blind end of the bore and ultimately tending to force the drill bit into the geological material to be drilled.

3. A downhole tool as claimed in claim 2 wherein said normal or forward direction of rotation of the drillstring is clockwise as viewed from the surface and looking down into the bore and said notional helix progresses anti-clockwise in a downhole direction therealong whereby the peripheries of said rolling element means, where they extend to the radially outermost periphery of the tool, align with a notional right-hand thread around the outer periphery of said tool.

4. A downhole tool as claimed in claim 1 wherein each respective axis of said rolling element means is skewed with respect to the longitudinal axis of the tool at an angle in the range from a very low (but non-zero) angle, up to 45°.

5. A downhole tool as claimed in claim 1, wherein said rolling element means are rollers, and the peripheries of said rollers are individually cylindrical or crowned.

6. A downhole tool as claimed in claim 5 wherein said rollers are individually mounted on a respective axis.

7. A downhole tool as claimed in claim 5, wherein said rollers are mounted in coaxial groups, such that within a group of rollers, individual rollers of that group are capable of rotating at mutually differing rotational rates.

8. A downhole assembly as claimed in claim 1, wherein said downhole assembly comprises a plurality of such downhole tools, and each being coupled between said rotatable motor output shaft and said rotatable motor output utilization means.

9. A downhole assembly as claimed in claim 1, wherein said rotatable motor output utilisation means comprises a drill bit, said at least one downhole tool comprised in said downhole assembly being arranged to increase the effective weight-on-bit during normally directed rotation of said drill bit by said downhole motor.

10. A downhole assembly as claimed in claim 1, wherein said motor housing is coupled to countertorque means for reacting motor torque output by said motor output shaft, said countertorque means rotationally constraining said motor housing with respect to said previously drilled hole.

11. downhole assembly as claimed in claim 10, wherein said countertorque means provides a rotational braking effect while allowing relative freedom of movement in a longitudinal direction.

12. A downhole assembly as claimed in claim 11, wherein said rotational braking effect is provided by forming said countertorque means with a peripheral array of hole-contacting rotatable rollers having their axes of rotation substantially tangential to notional circles substantially coaxial with the longitudinal axis of said downhole assembly.

13. A downhole assembly as claimed in claim 11, wherein said countertorque means comprises a further downhole tool, the notional helix of said further downhole tool being oppositely handed with respect to the notional helix of said at least one downhole tool coupled between said rotatable motor output shaft and said rotatable motor output utilisation means whereby relative contrarotation of said motor housing with respect to said motor output shaft results in commonly directed longitudinal forces at said at least one and further downhole tools comprised in said downhole assembly.

14. A downhole assembly as claimed in claim 12, wherein said downhole assembly has major components and sub-assemblies thereof longitudinally coupled by one or more couplings transmissive of torque and longitudinal forces but yieldable about axes transverse to the longitudinal axis whereby the downhole assembly may conform to bent holes.

15. A downhole tool as claimed in claim 4, wherein said angle is in the range from 0.5° to 15°.

* * * * *

UNITED STATES PATENT AND TRADEMARK OFFICE

CERTIFICATE OF CORRECTION

PATENT NO. : 5,649,603
DATED : July 22, 1997
INVENTOR(S) : Neil Andrew Abercrombie Simpson and Paul Raymond Coey It is certified that error appears in the above-identified patent and that said Letters Patent is hereby corrected as shown below:

Column 17, line 4, "12" should be --1--.

Signed and Sealed this

Twenty-third Day of December, 1997

Bruce Lehman

*Attest:*

BRUCE LEHMAN

*Attesting Officer*

*Commissioner of Patents and Trademarks*